United States Patent [19]

Ikemi et al.

[11] 4,199,967

[45] Apr. 29, 1980

[54] METHOD OF CONTROLLING A SHAPE OF A ROLLED SHEET

[75] Inventors: Shinichi Ikemi, Amagasaki; Koichi Ohba, Kobe, both of Japan

[73] Assignee: Mitsubishi Denki Kabushiki Kaisha, Tokyo, Japan

[21] Appl. No.: 958,393

[22] Filed: Nov. 7, 1978

[30] Foreign Application Priority Data

Nov. 9, 1977 [JP] Japan ..... 52/134917

[51] Int. Cl.[2] ..... B21B 37/06

[52] U.S. Cl. ..... 72/12

[58] Field of Search ..... 72/9, 17, 10–12, 72/205, 16

[56] References Cited

U.S. PATENT DOCUMENTS

| | | | |
|---|---|---|---|
| 3,882,709 | 5/1975 | Kawamoto et al. | 72/16 X |
| 3,934,438 | 1/1976 | Arimura et al. | 72/9 |

OTHER PUBLICATIONS

"Asea-Alcan AFC System . . .", Sivilotti et al., Iron & Steel Engr., Jun. 1973 pp. 83–90.

"Design and Development of a Metal Control System", Bravington et al., Met. Soc. (183), 1976, pp. 82–88.

"Operational Experience with a Vidiman Shapemeter . . .", Van Haperen et al., Met. Soc. (183), 1976, pp. 63–70.

*Primary Examiner*—Milton S. Mehr

*Attorney, Agent, or Firm*—Oblon, Fisher, Spivak, McClelland & Maier

[57] ABSTRACT

The forward slip and the backward slip at a first stand are dependant upon a draft, the back tension, the front tension, and the shape of a sheet in a tandem type rolling mill. It is difficult to control the shape solely by detecting the tension distribution between the last stand and the tension reel.

In the method of this invention, the shape of a rolled sheet is controlled by disposing a first shape meters between the pay-off reel and the first stand and a second shape meter between the last stand and the tension reel whereby shape control can be attained through a simple system.

Tension distributions detected by the two shape meters are functions of the forward slip and the backward slip. Accordingly the forward slips and the backward slips at all other stands except the first and last stands need not be considered when the tension distributions between the pay-off reel and the first stand and between the last stand and the tension reel are detected and the sums of these tension distributions produce a desired pattern. The shape control is attained by disposing a first shape meter at the input side of the first stand and a second shape meter at the output side of the last stand and by controlling the roll bending force and/or a roll coolant available at each stand so as to produce the sum in the desired pattern.

3 Claims, 30 Drawing Figures

FIG. 1A
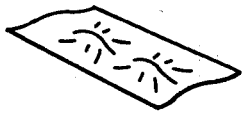
FIG. 1B
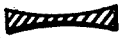
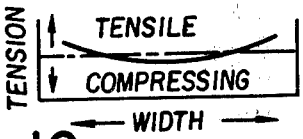
FIG. 1C
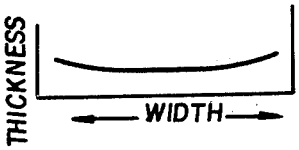
FIG. 1D
FIG. 2A
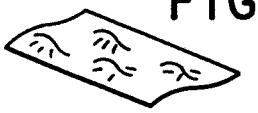
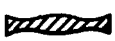
FIG. 2B
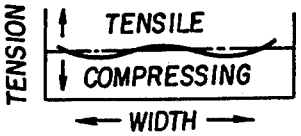
FIG. 2C
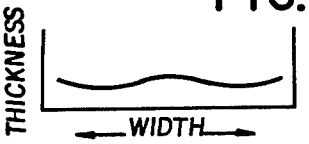
FIG. 2D
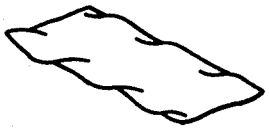
FIG. 3A
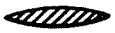
FIG. 3B
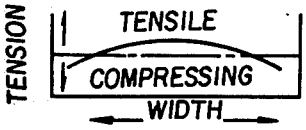
FIG. 3C
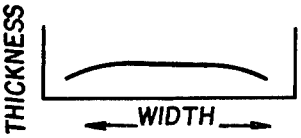
FIG. 3D

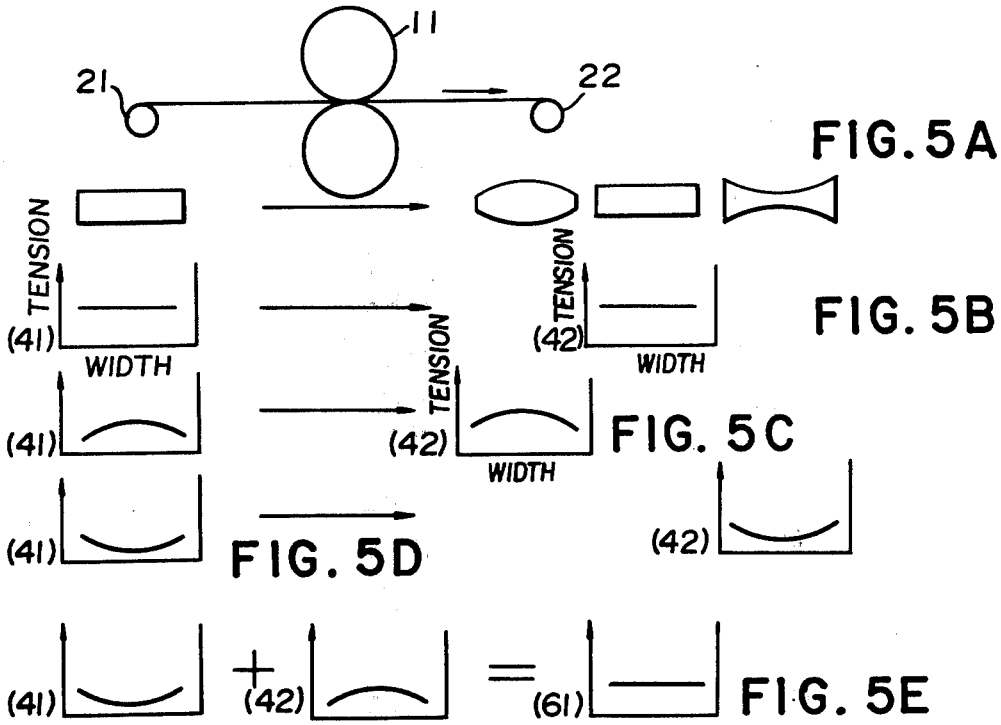
11
21
22
FIG. 5A
TENSION
(41)
WIDTH
TENSION
(42)
WIDTH
FIG. 5B
TENSION
(41)
(42)
WIDTH
FIG. 5C
(41)
FIG. 5D
(42)
(41)
+
(42)
=
(61)
FIG. 5E
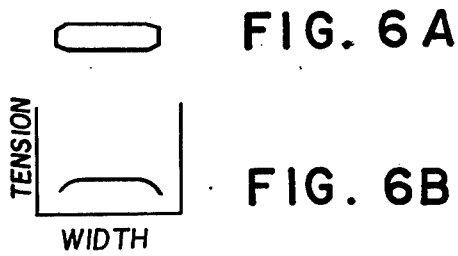
FIG. 6A
TENSION
WIDTH
FIG. 6B FIG. 7A
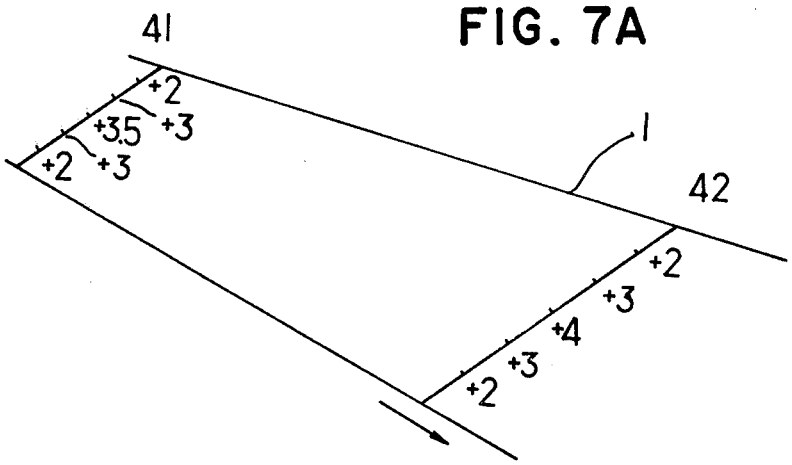
FIG. 7B
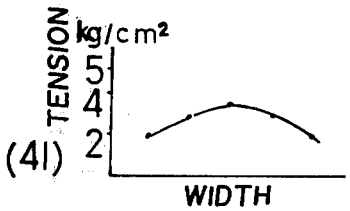
FIG. 7C
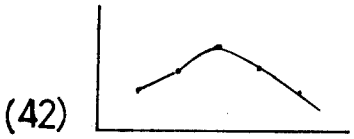
FIG. 7D
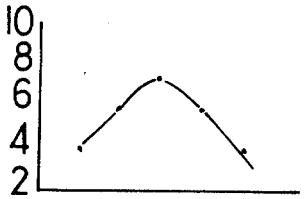
FIG. 7E
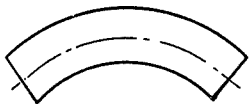
FIG. 7F
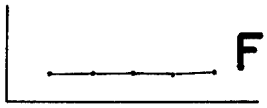
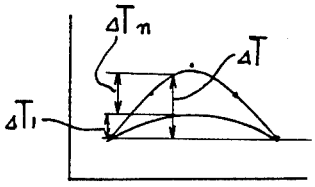
FIG. 7G

METHOD OF CONTROLLING A SHAPE OF A ROLLED SHEET

BACKGROUND OF THE INVENTION

The present invention relates to a method of controlling the shape of a rolled sheet in a tandem type rolling mill.

Usually, a rolled sheet, especially a thin sheet is prepared by rolling it in a rolling mill. In this method, the sheet is rolled to elongate it in the longitudinal direction so as to form a thinner sheet.

The elongation is dependant upon the ratio of draft to [(sheet thickness at input side—sheet thickness at output side)/(sheet thickness at input side)]. The distribution of the elongation in the transversal direction is dependant upon the distribution of the sheet thickness at the input side in the transversal direction and upon the distribution of the sheet thickness in the transversal direction after the rolling.

The distribution of the sheet thickness after the rolling is affected by the deformation of the rolling rolls such as:

1. an elastic deformation of the rolling roll;
2. a thermal expansion of the rolling roll caused by conducting heat from the rolled sheet to the rolling rolls; and
3. a wear of the rolling rolls caused by friction between the rolled sheet and the rolling roll.

The distribution of the elongation in the transversal direction is caused by the elongation of the rolled sheet in the longitudinal direction wherein compressing stress and tensile stress in the longitudinal direction remain as the distribution in the transversal direction. When the stresses are higher than certain limits, deformation of the rolled sheet is produced resulting in a backing phenomenon which is called a shape defect.

FIGS. 1, 2, and 3 show the relationship between the distribution of the sheet thickness after the rolling and the shape defect of the rolled sheet caused by the distribution of the sheet thickness for the case of a constant sheet thickness the input side.

In FIGS. 2 and 3, FIGS. 1A, 2A, and 3A show a schematic view of a rolled sheet having shape defect; FIGS. 1B, 2B, and 3B show a sectional view of the rolled sheet in the transversal direction; FIGS. 1C, 2C, and 3C show a tension distribution of the rolled sheet in the transversal direction; and FIGS. 1D, 2D, and 3D show a distribution of the rolled sheet in the transversal direction.

The shape defect shown in FIG. 1 is called a middle elongation or a center backing.

The condition shown in FIG. 2 is called a lug wave or a wave edge. This shape defect causes a failure of the apparatus or a deterioration of quality in the later steps.

Heretofore, in order to prevent such shape defects in the rolled sheet, the roll bending force under the last stand has been controlled. That is, in the conventional shape controlling method, it has been considered to be optimum to provide uniform front tension at the last stand. However, in the tandem type rolling mill, the uniformity of the draft distribution at the first stand in the transversal direction is usually difficult to maintain in that the distribution of the speed at the output side of the first stand is not uniform and has a certain distribution in the transversal direction. Thus, the backward slip at the first stand (provided one does not consider the back tension at the first stand) in the transversal direction is not uniform and is varied depending upon the shape of the sheet and the distribution of the sheet thickness at the input side of the first stand.

In order to produce a uniform distribution of the backward slip, it is necessary to provide a certain tension distribution between the pay-off reel and the first stand. Accordingly, even though a uniform front tension at the last stand is supplied, it has been impossible to produce a desired shape of the rolled sheet because of the back tension distribution at the first stand.

SUMMARY OF THE INVENTION

The present invention overcomes the above-mentioned disadvantages and provides the method of controlling a shape of a rolled sheet and provides an apparatus for controlling the shape of a rolled sheet with high accuracy.

The present invention which provides a method of controlling a shape of the rolled sheet comprises detecting the sum of the tension distribution of the sheet between the pay-off reel and a first stand and the tension distribution of the sheet between a last stand and a tension reel and controlling each roll bending force or each distribution of coolant for each roll at the last, first or other stand, so as to produce the desired pattern of the sums of the tension distributions.

BRIEF DESCRIPTION OF THE DRAWING

FIG. 1A is a schematic illustration of a shape defect in a rolled sheet;

FIG. 1B is a profile view of the shape defect shown in FIG. 1A;

FIGS. 1C and 1D are graphs showing tension and thickness distributions in a rolled sheet having a shape defect as shown in FIG. 1A;

FIG. 2A is a schematic illustration of a second shape defect in a rolled sheet;

FIG. 2B is a profile view of the shape defect shown in FIG. 2A;

FIGS. 2C and 2D are graphs showing tension and thickness distributions in a rolled sheet having a shape defect as shown in FIG. 2A;

FIG. 3A is a schematic illustration of a third shape defect in a rolled sheet;

FIG. 3B is a profile view of the shape defect shown in FIG. 3A;

FIGS. 3C and 3D are graphs showing tension and thickness distributions in a rolled sheet having a shape defect as shown in FIG. 3A;

FIG. 5A is a schematic view showing the profile of a rolled sheet before and after rolling;

FIGS. 5B through 5E illustrate tension distributions in the rolled sheet of FIG. 5A before and after rolling;

FIG. 6A shows a profile view of a rolled sheet;

FIG. 6B is a graph illustrating the tension distribution in the rolled sheet of FIG. 6A;

FIG. 7A is a schematic illustration of the tension distribution at two locations in the rolled sheet;

FIGS. 7B through 7D, and FIGS. 7F and 7G are graphs illustrating the tension distributions shown in the rolled sheet of FIG. 7A;

FIG. 7E is a schematic view of the roll shape of the sheet shown in FIG. 7A;

DETAILED DESCRIPTION OF THE PREFERRED EMBODIMENTS

Figure 4:
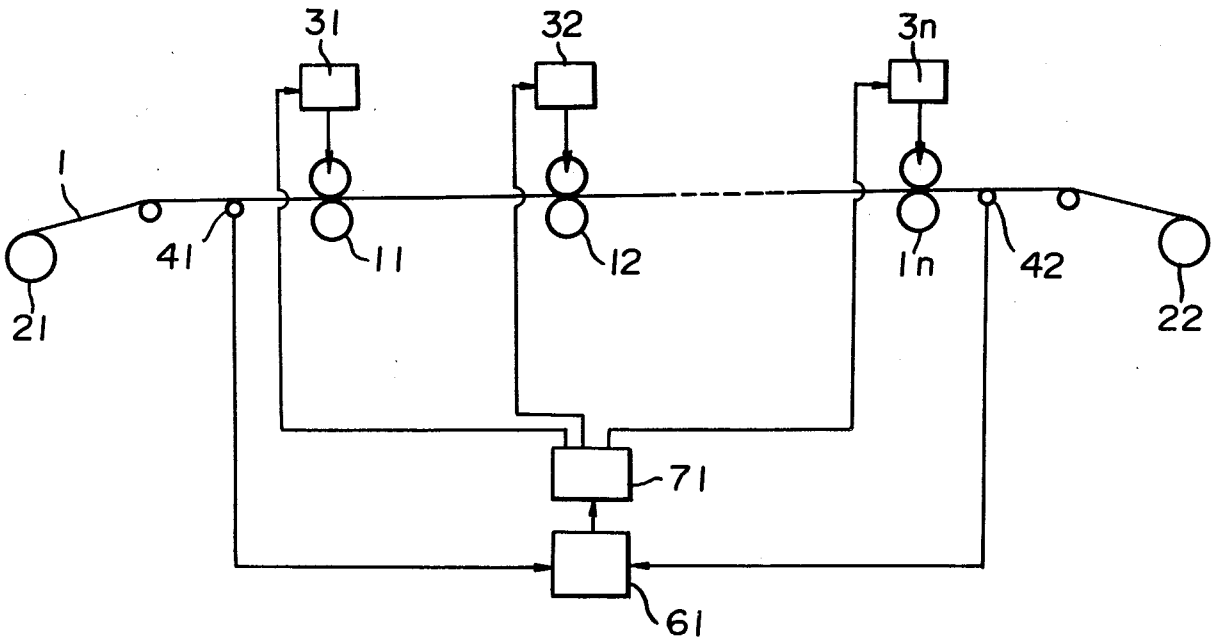
FIG. 4 is a block diagram which illustrates one embodiment of the present invention for controlling the shape of a rolled sheet.

FIG. 4 is a block diagram of one embodiment of the present invention wherein the reference numeral (1) designates a sheet; (11), (12) . . . (1n) designate rolling rolls; (21) designates a pay-off reel; (22) designates a tension reel; (31), (32) . . . (3n) designate roll bending force controlling devices; (41) and (42) designate shape meters for detecting each distribution of tensions in the transversal direction; (61) designates an arithmetic unit which obtains sums of distributions of tensions detected by the shape meters (41), and (42) and which determines whether the sums of the distributions of the tensions correspond to a desired pattern, such as a constant backward slip, and which determines the difference between the desired pattern and the distribution of the tensions; (71) designates an arithmetic unit which controls the roll bending force under the last stand or the first stand or each stand.

The relationship of the forward slip, the backward slip and the back tension under the principles of the present invention will be illustrated for the case where a flat sheet is fed from the output of the pay-off reel and the draft distribution at the first stand is in transversal direction.

The forward slip distribution $f_1(x)$ at the first stand is given by:

$$f_1(x)=g(\alpha 1(x),R_1(x)hi_1(x),\mu_1) \ldots \quad (1)$$

wherein:

$\alpha_1(x)$: draft distribution in transversal direction;

$R_1(x)$: roll radius distribution in transversal direction;

$hi_1(x)$: sheet thickness distribution at the input side in transversal direction $\mu 1$: friction coefficient x: distance from side edge of sheet When the roll radius distribution and the sheet thickness distribution at the input side are constant but the draft distribution is not constant, the forward slip $f_1(x)$ produces a distribution given by equation (1).

The backward slip distribution $\lambda_1(x)$ at the first stand is given by:

$$\lambda_1(x) = \frac{ho_1(x)}{hi_1(x)}(1 + f_1(x)) - 1 \quad (2)$$

wherein: $ho_1(x)$: sheet thickness at the output side.

The backward slip distribution is not constant; that is, a certain back tension is produced between the pay-off reel and the first stand. This back tension is dependent upon the backward slip distribution. The forward slip distribution produces a mass flow at the input and output of the first stand. When there is a sheet thickness distribution at the output side, the speed at the output side of the first stand has a certain distribution.

The above-mentioned description is summarized as follows: It is not sufficient even though the shape of the sheet is uniform on the pay-off reel. If the draft distribution under the first stand is different, the tension between the pay-off reel and the first stand will have a certain distribution; and moreover, the speed at the output of the first stand will have a certain distribution. The speed distribution of the sheet fed into the last stand in the transversal direction is dependant upon the first stand, the second stand, . . . , and the (n−1)th stand; and with regard to the shape of the rolled sheet, the input speed at the last stand is dependant upon the draft distribution at the first stand. That is, the sheet thickness at the output side of the second stand is dependant upon the sheet thickness at the output side and upon the output speed at the first stand. The sheet thickness at the output side of the third stand is dependant upon the sheet thickness at the output side and upon the output speed of the second stand. Accordingly, the sheet thickness at the input side and the input speed at the last stand are dependant upon the draft at the first stand and thus it is necessary to consider the draft distribution from the second stand to the (n−1)th stand. Therefore, in order to obtain a desired shape of the rolled sheet, the sums of the back tension distribution at the first stand and the front tension distribution at the last stand should be in a desired pattern.

Referring to FIG. 5, this problem will be further illustrated as follows:

FIGS. 5B to 5D show the distributions in the rolling by a single roll. FIG. 5A shows sectional views of the sheet (1) wherein the left view shows the sheet prior to rolling and the right views show various possible profiles of the sheet after rolling.

FIGS. 5B to 5E, are graphs wherein tension is given on the ordinate and each width of the sheet is given on the abscissa. In each Figure the left graph shows the tensions detected by the first shape meter (41) and the right graph shows the tensions detected by the second shape meter (42). These Figures illustrate the following:

FIG. 5B: Tension distribution in a flat sectional shape before and after rolling;

FIG. 5C: Tension distribution in a flat sectional shape before rolling and a side elongated sectional shape after rolling; and FIG. 5D: Tension distribution in a flat sectional shape before rolling and a center elongated sectional shape after rolling.

The tension distributions are respectively similar to the sectional shape in the case of a flat sheet thickness at the input side.

FIG. 5E shows the conditions provided by the controlling method shown in FIG. 4. The roll bending forces of the rolls (11), (12) . . . (1n) are controlled so that the sums of the tension distribution detected by the first shape meter (41) and the tension distribution detected by the second shape meter result in the distribution for a desired shape (such as flat shape in this case). When these forces are controlled as shown in FIG. 5E, the flat sectional shape is obtained.

The operation will be further illustrated with reference to FIGS. 7A, 7B, 7C, 7D, 7E, 7F, 7G. When the tension distribution in the transversal direction is as shown in FIG. 7A, the tension distributions detected by the shape meters (41) and (42) are as shown in FIGS. 7B and 7C. The arithmetic unit (61) operates to determine the sum of the tension distributions of FIGS. 7B and 7C. The roll bending force arithmetic unit (71) operates to produce a standard tension distribution, for example, flat tension distribution. The roll shape of the work is given as shown in FIG. 7E. As a further illustration the output side tension distribution $T_n$ detected by the shape meter (42) and the input side tension distribution $T_I$ detected by the shape meter (41) are given by the equations:

$$T_n=(a_nx^2+b_nx+c_n)+A_{n-1}(a_{n-1}x^2+b_{n-1}x+c_{n-1})R_{n-1}+\ldots+A_I(a_Ix^2+b_Ix+c_I)R_I\ldots \quad (3)$$

$$T_I=(a_1x^2+b_1x+c_1)R_1+A_2(a_2x^2+b_2x+c_2)R_2+\ldots A_{I-1}(a_{I-1}x^2+b_{I-1}x+c_{I-1})R_{I-1}\ldots \quad (4)$$

wherein: a, b, c: constant coefficients; A: funtional coefficients; R: roll bending force; x: distance in the transversal direction; n: last stand number; I: stand number in 1−n stands.

As shown in FIG. 5G, the tension for calibration ΔT is given by the equation:

$$\Delta T=\Delta T_n+\Delta T_I$$

The roll bending forces under the stands are controlled to provide R in the equations (3) and (4).

The sum of the tension distributions detected by the shape meters (41) and (42) should be the standard tension distribution.

When the sectional shape shown in FIG. 6A is given, the roll bending forces are controlled so that the sum of the tension distributions detected by the first and second shape meters (41) and (42) produces the distribution shown in FIG. 6B. (The sheet thickness at the input side is considered to be flat).

When the sheet thickness at the input side is not flat, it may be easy to determine sums of the tension distributions so as to produce a desired sectional shape.

When the sectional view of the rolled sheet has a thicker central portion, and the rolled sheet is wound on the tension reel (22), the central portion of the rolled sheet wound on the tension reel (22) becomes thick thereby producing the effect of for using a tension reel (22) having a longer radius at the center and a shorter radius at the ends. Accordingly, the tension at the center is higher than at the ends during normal operation. In such case, the standard tension distribution is not flat.

Figure 8:
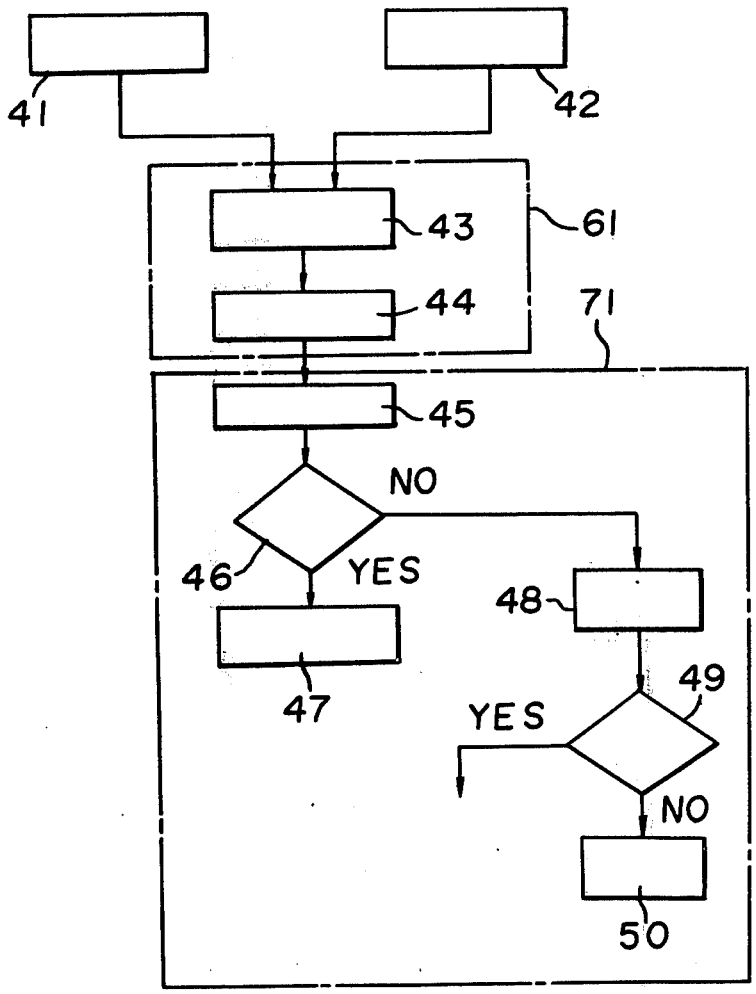
FIG. 8 is a flow chart which illustrates the operation of a major portion of the embodiment of the present invention shown in FIG. 4.

Referring to FIG. 8, the present invention will be further illustrated with regard to the operation of the arithmetic unit (61) and the roll bending force arithmetic unit (71) shown in FIG. 4.

FIG. 8 is a flow chart wherein the tension distribution between the pay-off reel and the first stand is detected by the shape meter (41) and the tension distribution between the tension reel and the last stand is detected by the shape meter (42). The sums of the detected tension distributions are calculated in the part (43) and the tension distribution is compared with a desired tension distribution to obtain the difference between them in the part (44). The draft distribution at the last stand is given by using the difference in the part (45). The determination whether the calculated draft distribution at the last stand is in an allowable range or not is performed in the part (46). When it is in the allowable range, a roll bending force under the last stand is calculated in the part (47). When it is out of the allowable range, a roll bending force under the first stand is calculated in the part (48). The as to whether the calculated roll bending force under the first stand affects the accuracy of the sheet thickness or not is performed in the part (49). When the sheet thickness can be adjusted by this effect, the roll bending force under the first stand is controlled. When the sheet thickness can not be adjusted by this effect, the draft of the roll bending force under the middle stand and the required roll bending force are calculated at the part (50). Thus, the rolling operation for controlling the shape of the rolled sheet is performed to obtain a desired shape of the rolled sheet.

Figure 9:
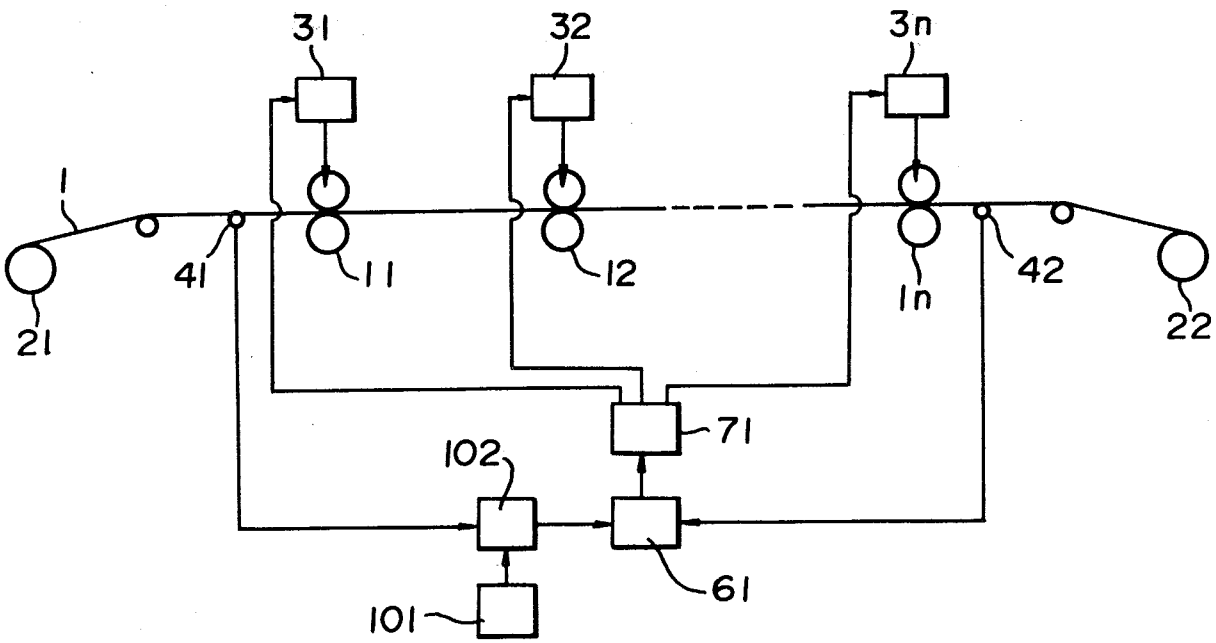
FIGS. 9 and 10 are block diagrams which illustrate other embodiments of the present invention.
Figure 10:
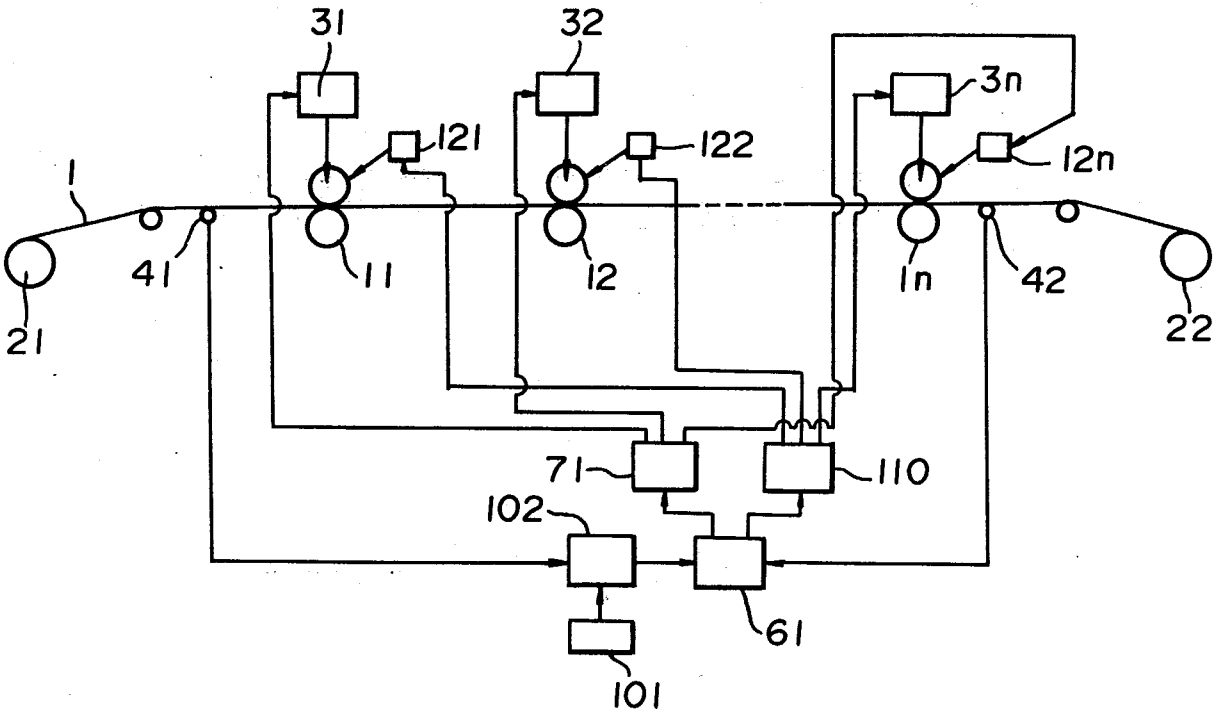

FIGS. 9 and 10 show block diagrams of the other embodiments of the method of controlling the shape of the rolled sheet according to the present invention.

In FIG. 9, reference numeral (101) designates an arithmetic unit which operates a time delay from the time of nipping the sheet under the first stand to the time of nipping the sheet under the last stand. Reference numeral designates a delay device for delaying the time detected by the shape meter (41) depending upon the delay time calculated by the arithmetic unit (101).

In FIG. 10, reference numeral (110) designates an arithmetic unit for determining an amount of a roll coolant; and numerals (120), (121) . . . (12n) designate roll coolant controlling devices. When the shape of the sheet can not be controlled through the use of the roll bending forces acting alone, the shape of the sheet is controlled by varying the distribution of roll coolant in the transversal direction.

What is claimed is:

1. A method of controlling a shape of a rolled sheet in a tandem type rolling mill which comprises detecting tension distributions of the sheet in the transversal direction, between a pay-off reel and a first stand and between a last stand and a tension reel by a first and second shape meters; and controlling each roll bending force or each distribution of a roll coolant at the last, first and other stand so as to give a desired pattern of forward slip and backward slip in the transversal direction as sums of tension distributions detected by said first and second shape meters.

2. A method of controlling a shape of a rolled sheet according to claim 1 wherein a roll bending force under the last stand is controlled so as to give the desired pattern as the sums of the tension distributions detected by said first and second shape meters; and when it is found not to give the desired pattern as the sums of the tension distributions by controlling the roll bending force under the last stand, the roll bending force under the first stand is controlled; and when it is found not to give the desired pattern as the sums of the tension distributions by controlling the roll bending force under the first stand, the roll bending force under a middle stand disposed between the first and last stands is controlled; and when it is found not to give the desired pattern as the sums of the tension distributions by controlling the roll bending force under the middle stand a distributions of the roll coolant is controlled.

3. A method of controlling a shape of a rolled sheet according to claim 1 wherein said desired pattern is flat in the transversal direction of the rolled sheet.

* * * * *